US005944382A

United States Patent [19]

Ambasz

[11] Patent Number: 5,944,382

[45] Date of Patent: Aug. 31, 1999

[54] ADJUSTABLE SEATING

[75] Inventor: Emilio Ambasz, Buenos Aires, Argentina

[73] Assignee: Center for Design Research and Development N.V., Netherlands Antilles

[21] Appl. No.: 08/946,397

[22] Filed: Oct. 7, 1997

[30] Foreign Application Priority Data

Oct. 9, 1996 [JP] Japan ..... 8-268504

[51] Int. Cl.[6] ..... A47C 3/00

[52] U.S. Cl. ..... 297/300.1; 297/343

[58] Field of Search ..... 297/337, 341, 297/342, 343, 301.1, 301.4, 284.4, 353

[56] References Cited

U.S. PATENT DOCUMENTS

| | | |
|---|---|---|
| 1,105,990 | 8/1914 | Miller . |
| 1,712,727 | 5/1929 | Birdsall . |
| 2,446,185 | 8/1948 | Masucci et al. . |
| 2,627,898 | 2/1953 | McStay Jackson . |
| 3,059,971 | 10/1962 | Becker . |
| 3,203,732 | 8/1965 | Hoffman . |
| 3,536,358 | 10/1970 | Masucci . |
| 3,567,280 | 3/1971 | Bradshaw . |
| 3,982,785 | 9/1976 | Ambasz . |
| 4,084,850 | 4/1978 | Ambasz . |
| 4,131,260 | 12/1978 | Ambasz . |
| 4,157,203 | 6/1979 | Ambasz . |
| 4,362,336 | 12/1982 | Zapf et al. . |
| 4,711,491 | 12/1987 | Ginat . |
| 5,108,149 | 4/1992 | Ambasz . |

FOREIGN PATENT DOCUMENTS

| | | |
|---|---|---|
| 979 923 | 5/1951 | France . |
| 298 089 | 7/1954 | Germany . |
| 35-11843 | 6/1935 | Japan . |
| 61-3407 | 2/1986 | Japan . |
| 61-57003 | 12/1986 | Japan . |
| 62-12349 | 3/1987 | Japan . |
| 5-38602 | 6/1993 | Japan . |
| 7316482 | 6/1974 | Netherlands . |
| 327 439 | 4/1930 | United Kingdom . |
| 665 375 | 1/1952 | United Kingdom . |
| 998 855 | 7/1965 | United Kingdom . |
| 1 276 274 | 6/1972 | United Kingdom . |
| 1 495 080 | 12/1977 | United Kingdom . |
| 1 497 704 | 1/1978 | United Kingdom . |
| 1 549 041 | 7/1979 | United Kingdom . |

OTHER PUBLICATIONS

Krueger product catalog, "Vertebra vs. the backache syndrome," 1978.

*Primary Examiner*—Milton Nelson, Jr.
*Attorney, Agent, or Firm*—Baker & Botts, L.L.P.

[57] ABSTRACT

Adjustable seating has a frame, a seat bottom mounted on the frame so as to slide forwardly and rearwardly, and a seat back mounted on the frame so as to slide upwardly and downwardly and also to tilt rearwardly from a resiliently restrained upright position. A lumbar back is mounted on the frame between the seat bottom and seat back so as to move generally in coordination with movements of the seat bottom and seat back. The lumbar back provides good support for the lumbar portion of the body of a person seated in the seating in all postures and all positions of the seat bottom and seat back.

8 Claims, 9 Drawing Sheets

ADJUSTABLE SEATING

BACKGROUND OF THE INVENTION

The present invention relates to adjustable seating in which a seat back and seat bottom move relative to a frame.

Adjustable seating of this type, which is disclosed in U.S. Pat. No. 5,108,149, has a frame that includes a seat-supporting portion and a back-supporting portion, a seat bottom mounted on the seat-supporting portion for sliding movement between rearward and forward positions, and a seat back mounted on the back-supporting portion by a resilient articulating linkage for tilting movement independently of the position of the seat bottom between a resiliently restrained upright position and a tilted-back position. The seat back is mounted on an upper linkage member of the resilient articulating linkage so that the seat back can slide downwardly or upwardly relative to the back-supporting portion. A compressed coil spring engaged between the seat back and the back-supporting portion of the frame yieldably biases the seat back to an upward position. A coupling member connects the seat back to the seat bottom.

The adjustable seating of U.S. Pat. No. 5,108,149 functions such that a person sitting in it can change his or her sitting posture between an upright position and a reclined posture (leaning back). When the seat bottom slides forward or backward, the seat back also moves up or down. Therefore, the person sitting in the chair can take a relaxed posture. With this arrangement, there is provided an advantage of not causing pulling and rumpling of clothing because of no relative movement between the person's back and the seat back. In addition, the back region of the person sitting in the chair is well supported in the relaxed position.

However, total comfort is not provided because the whole lumbar region is not well supported at any time due to a substantial space existing between the seat bottom and the seat back.

SUMMARY OF THE INVENTION

An object of the present invention is to provide an adjustable chair of the above-mentioned type wherein a seat is arranged to provide good support for the whole lumbar region of a person sitting in the chair.

According to the present invention, there is provided an adjustable seating having a frame that includes a seat-supporting portion and a back-supporting portion, a seat bottom mounted on the seat-supporting portion for sliding movement between rearward and forward positions, and a seat back mounted on the back-supporting portion by a resilient articulating linkage for tilting movement independently of the position of the seat bottom between a resiliently restrained upright position and a tilted-back position. The seat back is mounted on an upper linkage member of the resilient articulating linkage so that the seat back can slide downwardly or upwardly relative to the back-supporting portion. A compressed coil spring engaged between the seat back and the back-supporting portion of the frame yieldably biases the seat back to an upward position.

The present invention is characterized in that the frame has a lumbar back-supporting portion between the seat-supporting portion and the back-supporting portion and a lumbar back is mounted between the seat bottom and the seat back on the lumbar back-supporting portion for sliding movement, whereby when the seat bottom and the seat back are moved along the frame, the lumbar back moves along the lumbar back-supporting portion of the frame following the sliding movement of the seat bottom and the seat back.

The adjustable chair according to the invention is, preferably, further characterized in that the lumbar back is retained in a floating condition by means of bellows members connected between the lumbar back and the seat bottom and between the lumbar back and the seat back.

The adjustable chair according to the invention may further comprise coupling members connected between the lumbar back and the seat bottom and between the lumbar back and the seat back, whereby when the seat bottom is moved forwardly or rearwardly along the frame, the lumbar back and the seat bottom move downwardly or upwardly along the frame following the sliding movement of the seat bottom.

For a better understanding of the invention, reference may be made to the following description of embodiments of the invention, taken in conjunction with the accompanying drawings.

DESCRIPTION OF THE EMBODIMENTS

Figure 1:
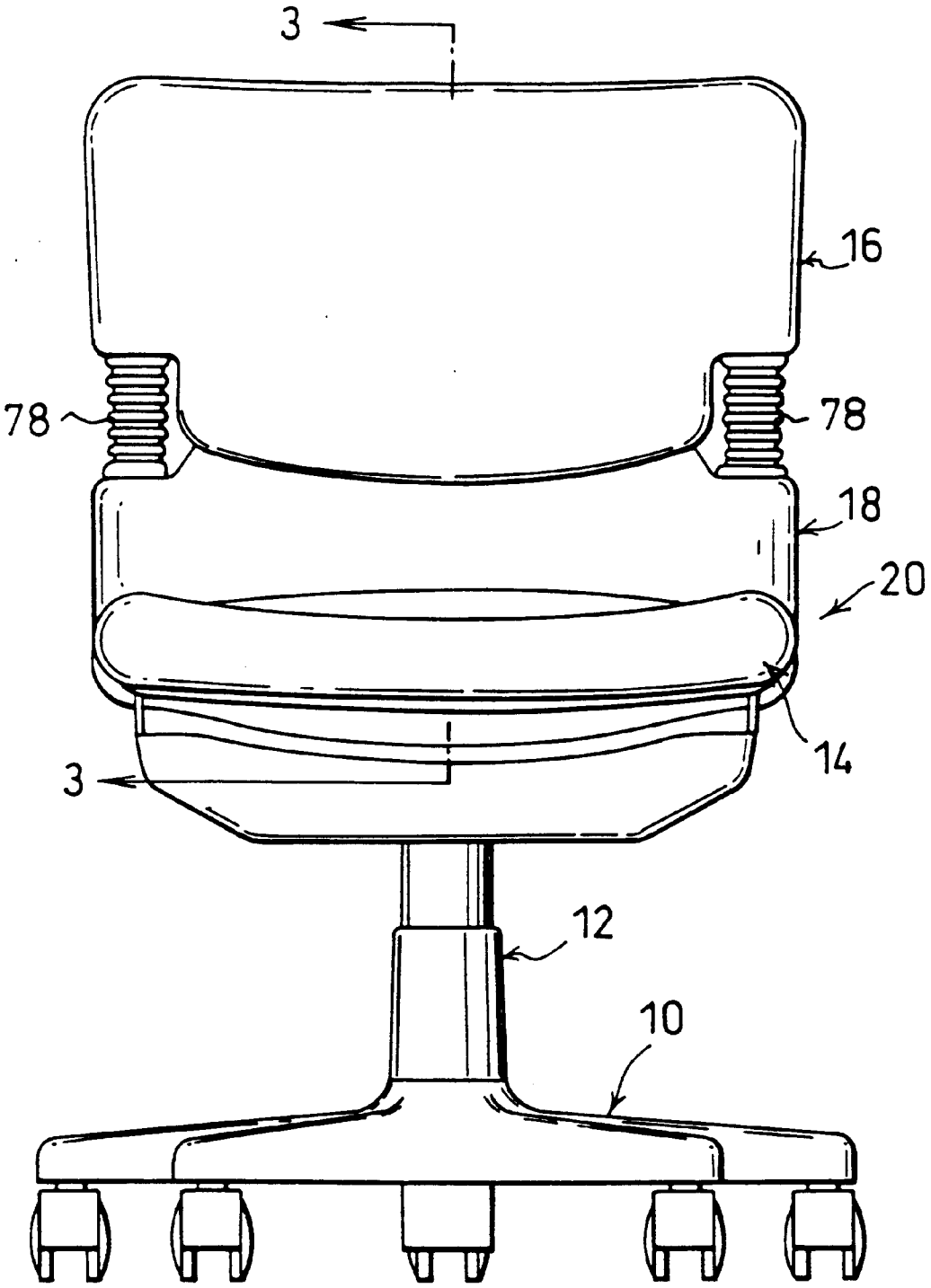
FIG. 1 is a front view of an adjustable chair according to the invention.
Figure 2:
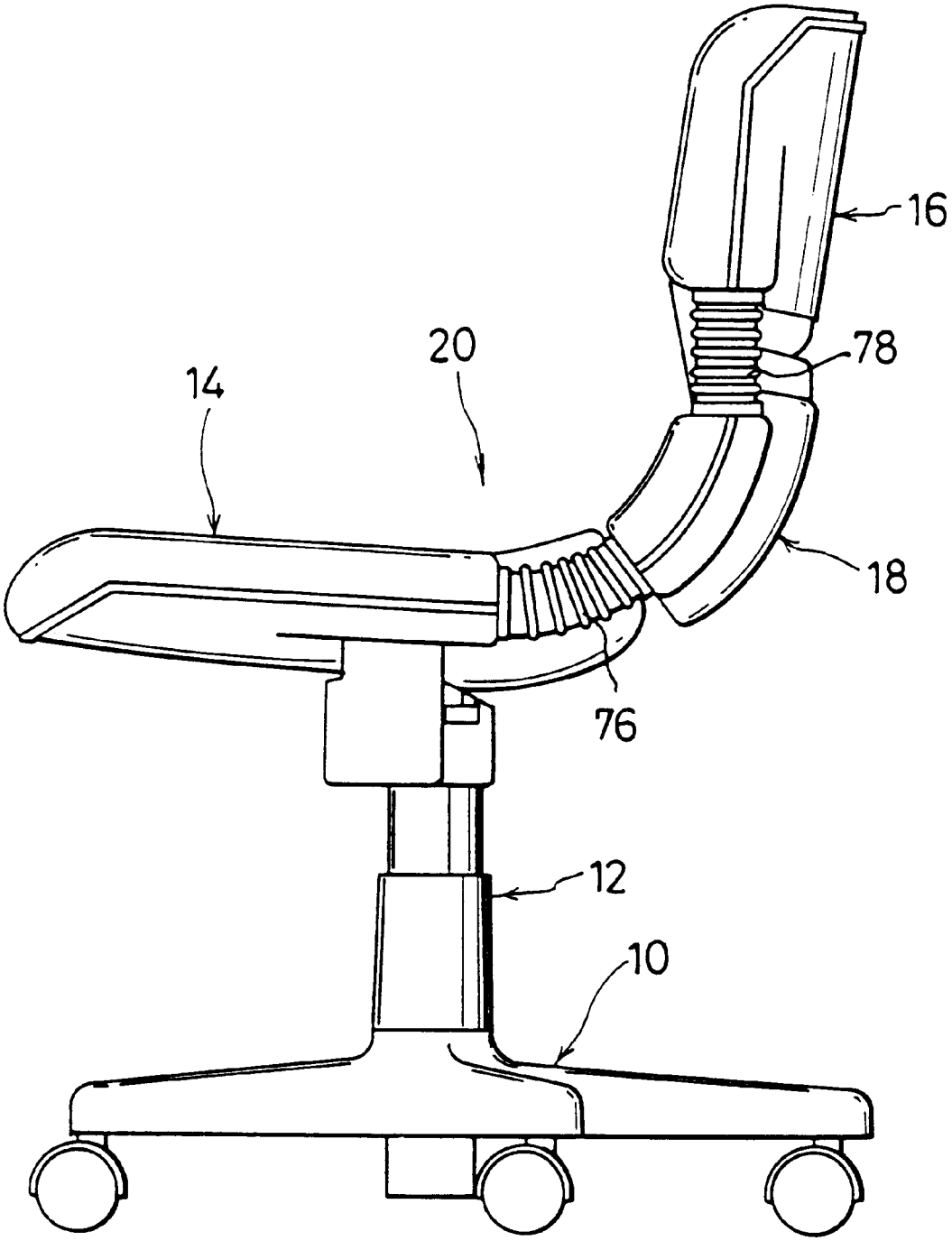
FIG. 2 is a side view of the chair of FIG. 1.
Figure 3:
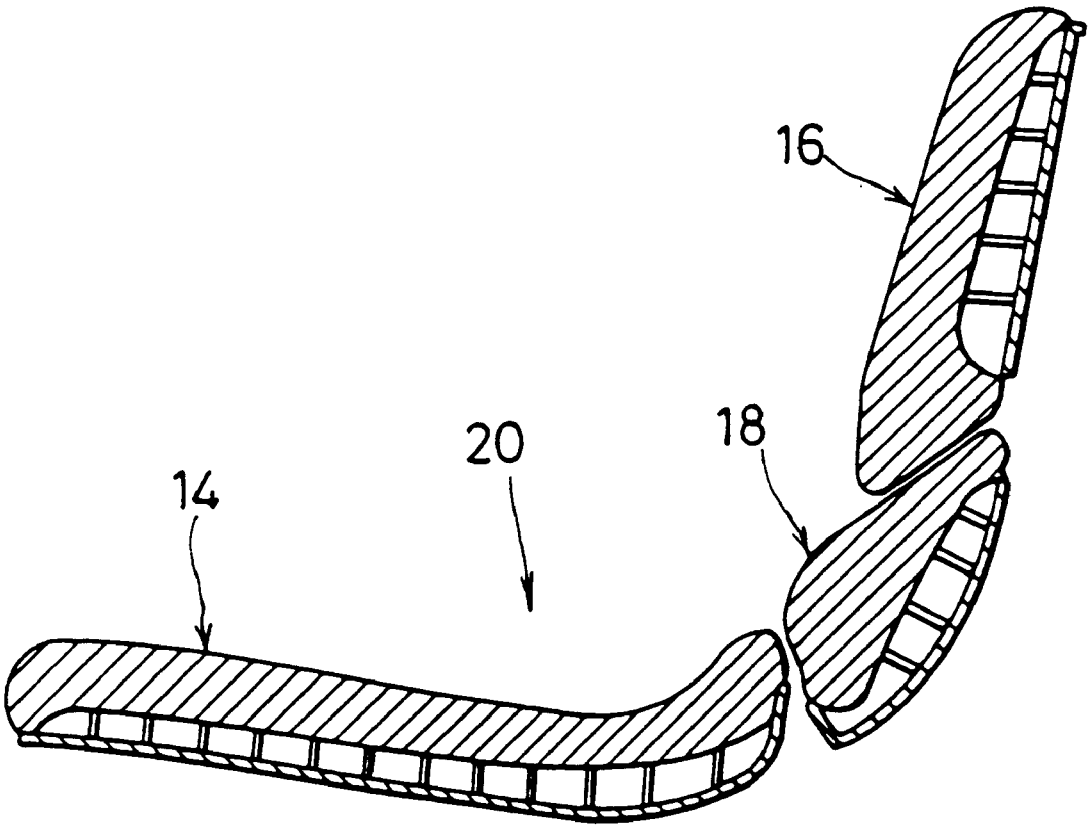
FIG. 3 shows a cross section taken along line 3—3 of FIG. 1.

Referring now to FIGS. 1, 2 and 3, a chair according to the present invention comprises a castered pedestal base 10, a support column 12, and a seat 20 that has a seat bottom 14, a seat back 16 and a lumbar back 18 interposed between the seat bottom 14 and the seat back 16. As shown in FIGS. 4 through 7, the seat bottom 14, seat back 16 and lumbar back 18 are based on a bottom component 22, a back component 24 and a lumbar component 26, respectively, each of which is molded from a rigid polymeric material. The bottom component 22 has a socket 28 along side edges thereof, which is fitted over a seat-supporting portion 34 of a frame comprising a frame side tube 32 on each side, in a telescoping relation, the side frame tubes 32 being secured to a cross member 30 on the support column 12 of the chair. Each side frame tube 32 is generally L-shaped in lateral profile, bending arcuately upwardly at the rear of the seat-supporting portion 34 to provide a lumbar back supporting portion 36. The lumbar back supporting portion 36 can be straight instead of being arcuate as illustrated. The seat bottom component 22 slides freely forward and backward by virtue of the telescoping relation of the socket 28 and the seat-supporting portion 34 of the side frame tube 32, but is pulled by means of a tension spring mechanism 31 so that the seat bottom is normally in its rearward retracted position. The tension spring mechanism 31 comprises a connecting rod fixed at its one end to the forward end of the seat component 22 and extending into the socket 28, a spring mounting member 35 fixed at its one end to the forward end of the side frame tube 32 and extending into the side frame tube 32, and a tension spring 37 connected at its one end to the connecting rod 33 and at the other end to the mounting member 35.

The back component 24 has at each side a socket 38 which opens downwardly. Each socket 38 receives a tubular casing 42 of a posture control spring mechanism 40, which is appropriately secured to the socket 38. An upper tubular linkage member 46 of a resilient articulating linkage 44, defining the frame back supporting portion, is received in the tubular casing 42. A lower tubular linkage member 48 is fitted in and fixed to the upper end of each side frame tube 32. A coupling rod 50 has its lower end defining together with the lower tubular linkage member 48 a ball and socket joint 52. The upper tubular linkage member 46 has a tubular fitting 54 secured to the lower end thereof. The tubular fitting 54 seats in a circular groove 56 in the upper end of the lower tubular linkage member 48. The upper end of the coupling rod 50 has a spring retainer 60 abutting a nut 58 screwed onto the rod and slidably received in the upper tubular linkage member 46. An articulation control spring 62 is disposed between the spring retainer 60 and tubular fitting 54 under compression. The spring force holds the fitting 54 seated in the groove 56 but yields to a rearward force against the seat back 16 exerted by the person sitting in the chair and allows the seat back to tilt rearwardly, the rear part of the circular groove 56 being the fulcrum about which the seat back pivots. The extent of rearward tilting is limited by a stop tube 64. The stop tube 64 is received in the lower portion of the upper tubular linkage member 46 and abuts the fitting 54. When the spring retainer 60 engages the upper edge of the stop tube 64, the engagement prevents the seat back 16 from further tilting rearwardly. When the force of the sitter's back that caused the seat back to tilt rearwardly is no longer applied, the force of the articulation control spring 62 which seeks to keep the fitting 54 seated in the circular groove 56, pushes the fitting back into seated relation, thereby restoring the seat back 16 to the upright position.

A compression coil spring 68 is disposed under compression between the upper shoulder and a spring seat 47 fixed to the upper end of the upper linkage member 46 to always bias the seat back 16 upwardly with respect to the upper linkage member 46. The maximum extent of upward movement of the seat back 16 is limited by engagement of a stopper 72 fixed to the upper portion of the upper linkage member 46 with the lower end of a slot 70 in the socket 38 and the tubular casing 42.

The lumbar back component 26 has at each side of a ribbed shell portion 26*s* (FIG. 3); a socket 74 that slidably receives in telescoping relation the arcuate portion 36 of the corresponding frame side tube 32. The sliding, telescoping relation between the respective sockets 74 and arcuate portions 36 permit the lumbar back component 26 to slide along an arcuate path relative to the frame side tubes 32. As mentioned above, the sockets 74 and the portions 36 can be straight rather than arcuate. The lumbar back of the chair seat provides comfortable support for the anatomical lumbar region of the back of a person sitting in the chair. When the person changes his sitting position, the lumbar back of the chair seat can change position so that it remains in contact with the anatomical lumbar back of the person.

Figure 4:
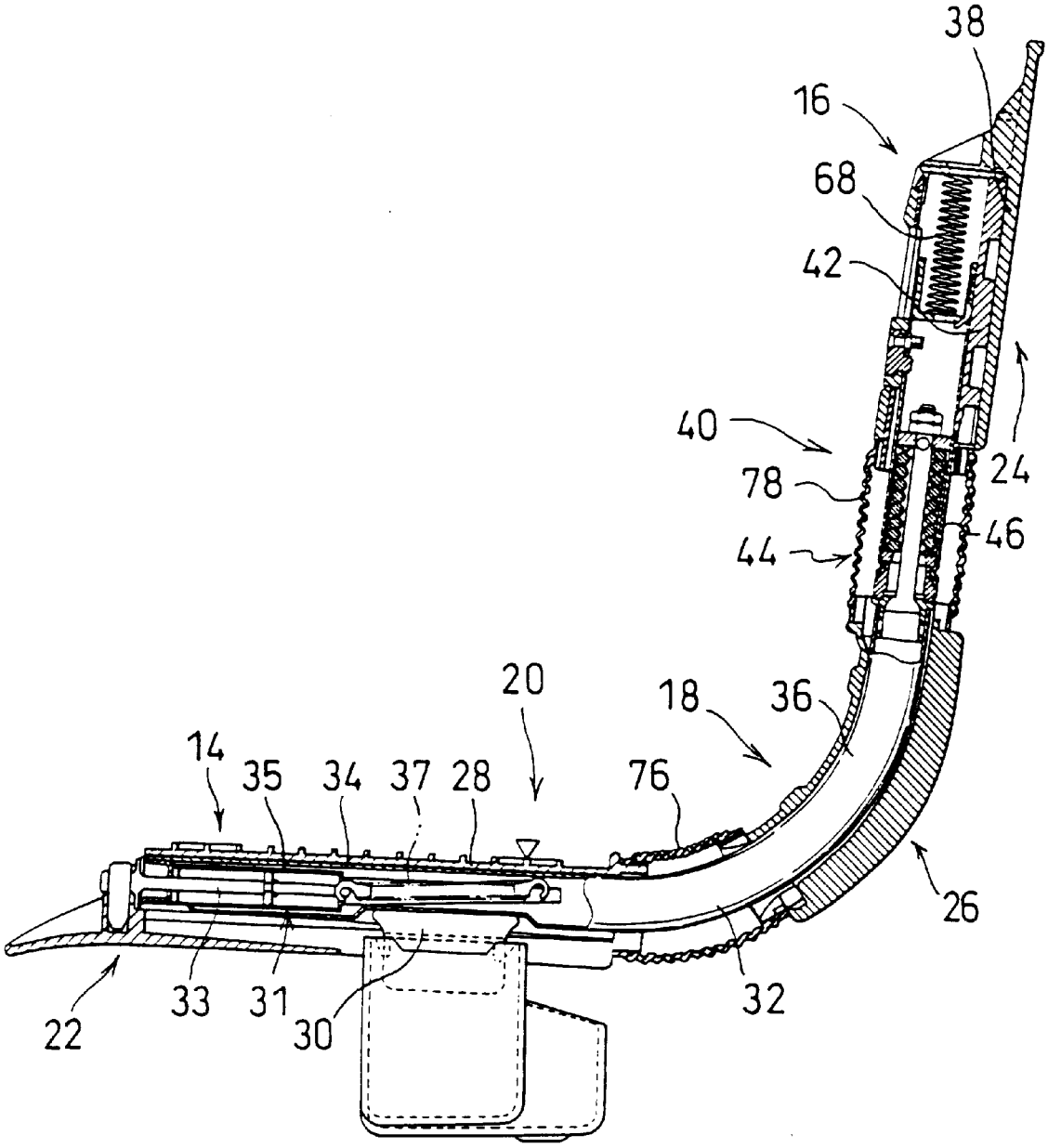
FIG. 4 shows a cross section of a relation among a seat bottom, lumbar back, seat back and chair frame according to the first embodiment of the adjustable chair of the invention.
Figure 5:
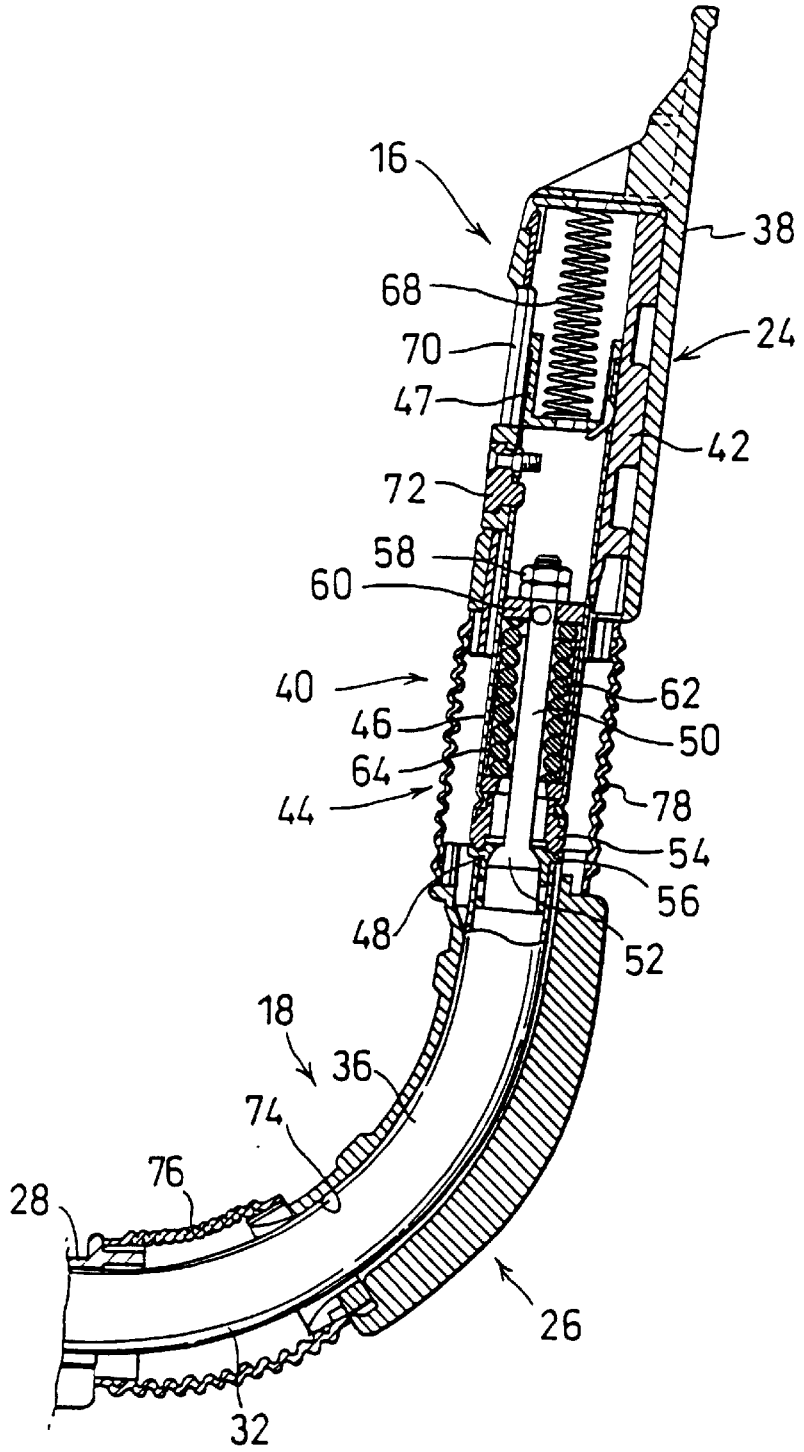
FIG. 5 shows an enlarged cross section of a portion of FIG. 4.

In the first embodiment of the invention, as shown in FIGS. 4 and 5, the lumbar back 18 is connected to the seat bottom 14 and the seat back 16 by means of elastomeric bellows members 76, 78 attached to those components and adapted to conceal the lumbar back-supporting portion of the side frame tube 32 and the tubular casing 42 of the posture control spring mechanism 40. As can been seen in FIGS. 1 through 3, the lumbar back 18 is retained between the seat bottom 14 and the seat back 16 in a floating condition under resilience of the elastomeric bellows members 76, 78, without making direct contact with the seat bottom 14 and the seat back 16. The lumbar back 18 can support the whole lumbar of the person sitting in the chair in the upright posture.

Figure 6:
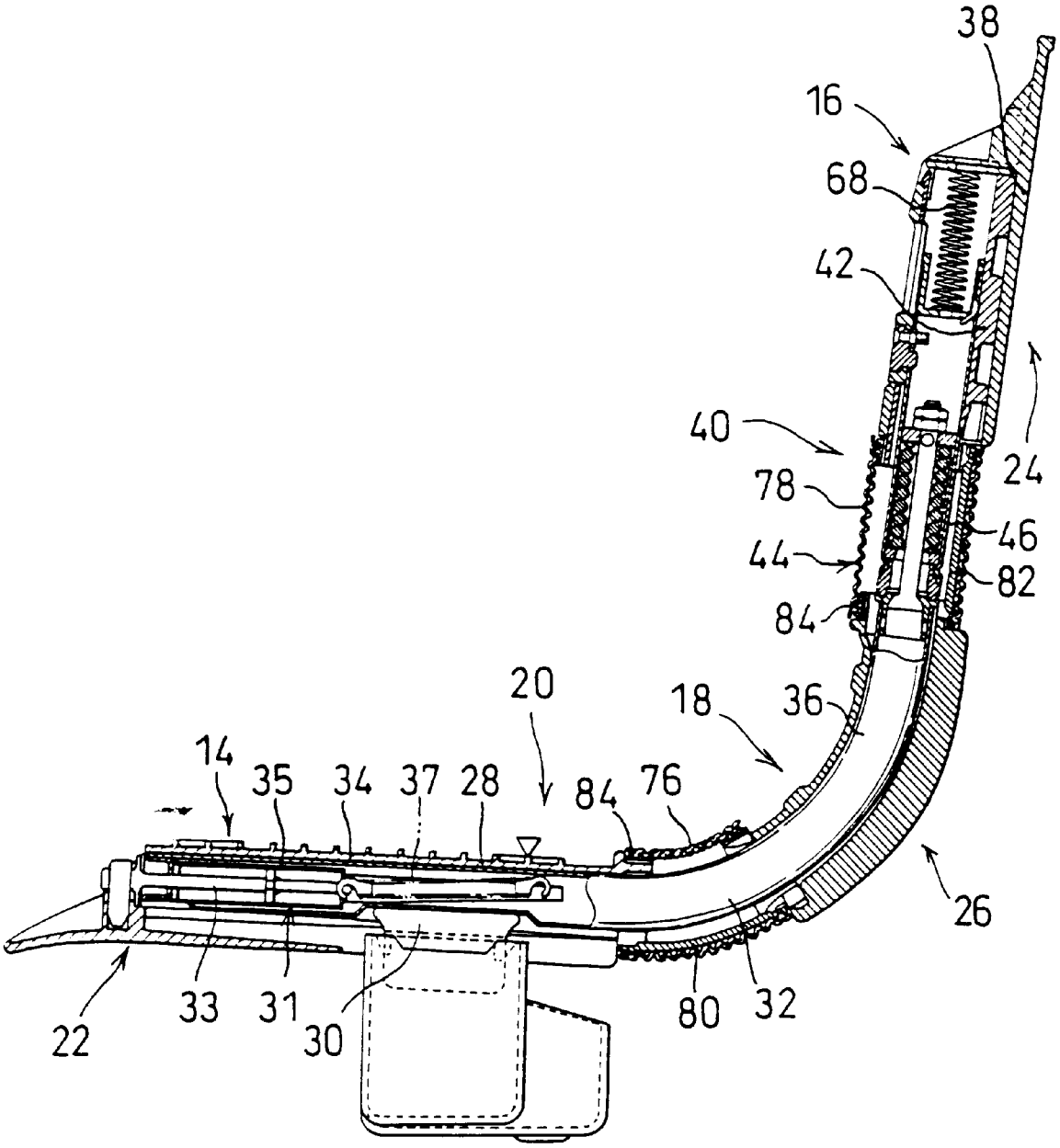
FIG. 6 shows a cross section of a relation among the seat bottom, lumbar back, seat back and chair frame according the second embodiment of the adjustable chair of the invention.
Figure 7:
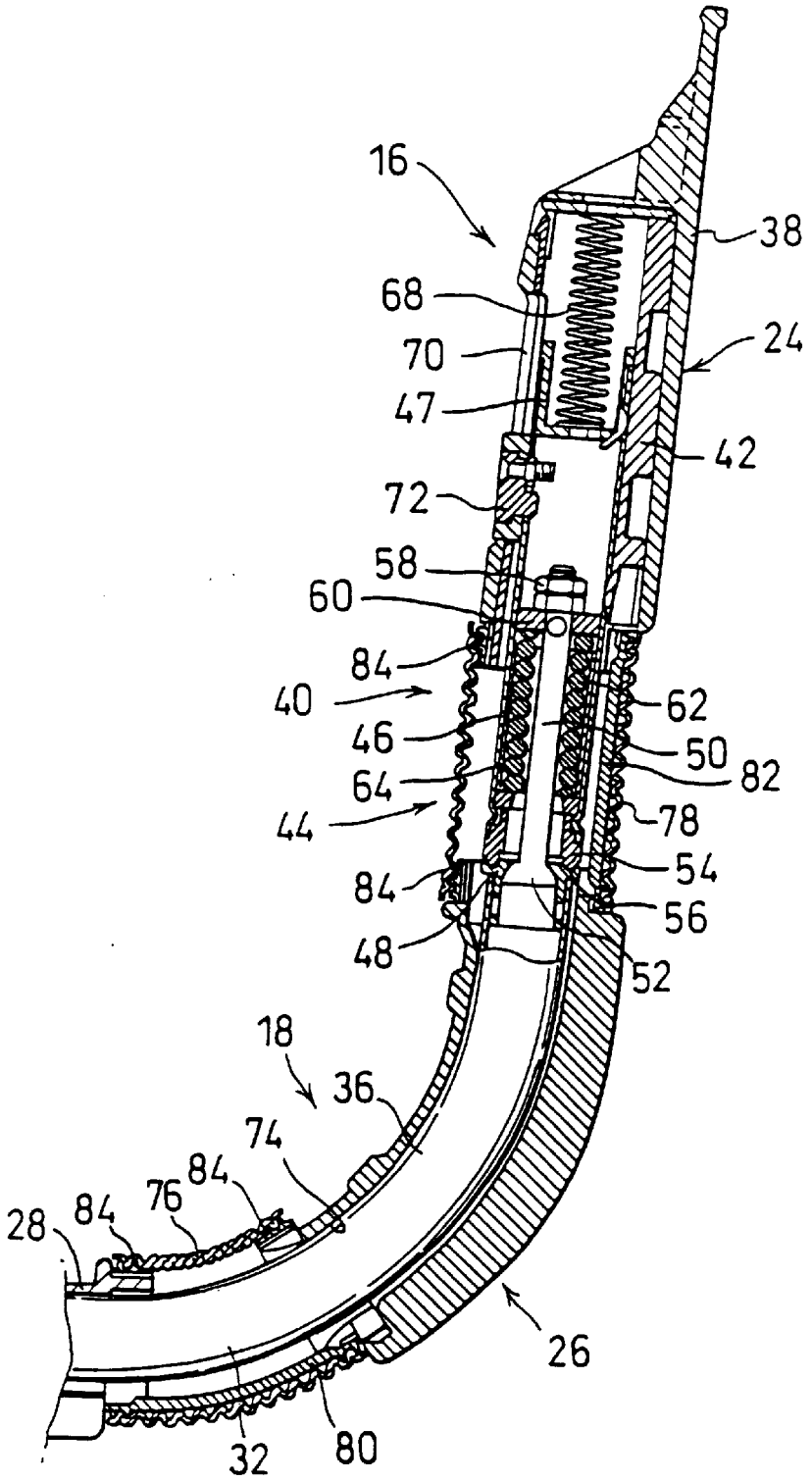
FIG. 7 shows an enlarged cross section of a portion of FIG. 6.
Figure 8:
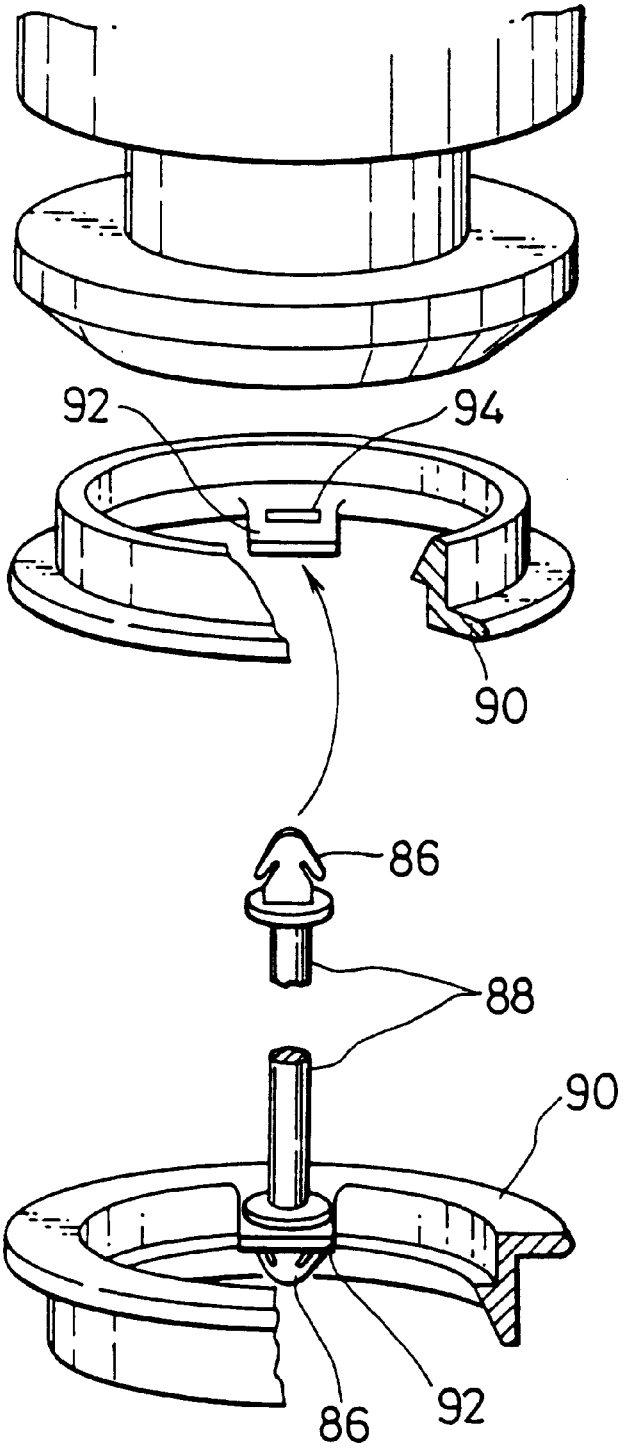
FIG. 8 is a perspective view of an alternative embodiment of a coupling member which can be used in the adjustable chair of the invention.
Figure 9:
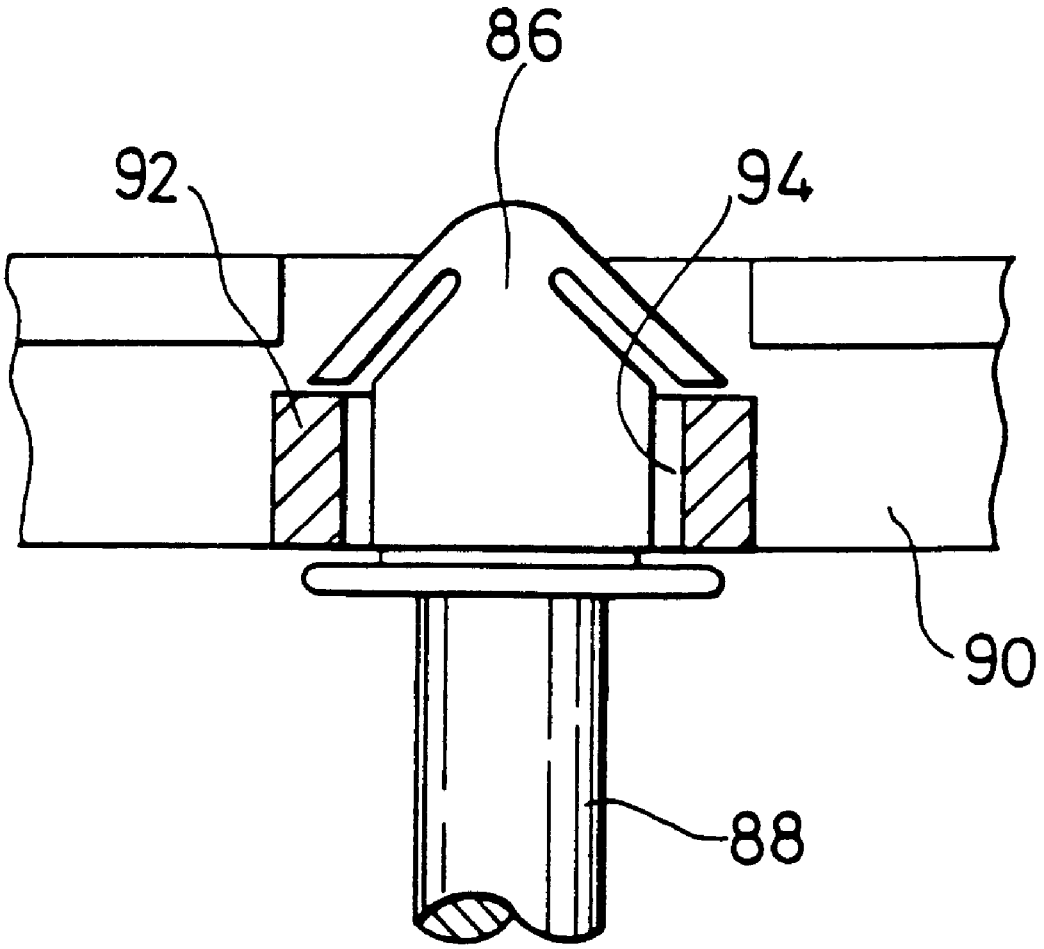
FIG. 9 is a fragmental cross section of a connection between a coupling rod and a ring member of the coupling member shown in FIG. 8.

In the second embodiment of the invention, as shown in FIGS. 6 and 7, the lumbar back 18 is coupled to the seat bottom 14 and the seat back 16 by means of coupling members 80, 82 of synthetic resin material. Each of the coupling means 80, 82 comprises a strip formed integrally with ring members 84 attached to the sockets 28 and 74 of the seat component and the lumbar back component or the sockets 38 and 74 of the back component and the lumbar back component. The elastomeric bellows members 76, 78 are positioned to conceal the coupling members 80, 82, respectively, and are attached at their ends to the ring members 84 of the coupling members 80, 82. Each of the coupling members can have separate ring members. FIG. 8 shows such an arrangement. Each of the coupling members is in the form of a coupling rod 88 with detent heads 86. The coupling rod 88 is connected to the ring members 90 by inserting each of the detent heads 86 into an opening 94 in a lug 92. The connection between the detent heads 86 and the ring member 90 is shown in detail in FIG. 9.

When the person sitting in the chair presses his or her back against the seat back 16 and applies a forward force on the seat bottom 14, the seat bottom 14 slides forward against the action of the tension spring 37, the downward movement of his or her back causing the seat back 16 to slide downwardly against the action of the compression coil spring 68 while at this point, the seat back 16 comes into contact with the lumbar back 18 to cause it to move downwardly. When the person sitting in the chair leans back, the seat back will articulate rearwardly. As the person ceases to assume the relaxed-reclined posture, the seat bottom 14 returns to the rearward position under the action of the tension spring 37 while the seat back 16 also returns upwardly under the action of the compression coil spring 68. The lumbar back 18 is returned by the moving seat bottom 14 engaging therewith. In the embodiment having the coupling members, the forward sliding movement of the seat bottom 14, as well as the downward sliding movement of the seat back 16, causes the lumbar back 18 to slide downwardly in substantially the same manner as in the previous embodiment. When the person ceases to assume the relaxed-reclined posture, the lumbar back 18 is returned following the returning movement of the seat bottom 14 and the seat back 16 through the coupling members 80, 82.

It will be noted from the foregoing that the present invention provides an adjustable chair wherein a lumbar back is disposed between the seat bottom and the seat back, the lumbar back being capable of moving together with the seat bottom and the seat back and, thus, the pulling and rumpling of clothing is minimized and the lumbar back, together with the seat bottom, provides good support for the whole lumbar of the person in the upright posture to provide comfortable seating.

I claim:

1. Adjustable seating comprising a frame that includes a seat-supporting portion, a back-supporting portion and a lumbar back-supporting portion between the seat-supporting portion and the back-supporting portion;

a seat bottom mounted on the seat-supporting portion of the frame for sliding movement between rearward and forward positions, a seat back mounted on the back-supporting portion of the frame by an upper linkage member of a resilient articulating linkage for tilting movement between a resiliently restrained upright position and a tilted-back position, and for sliding movement downwardly or upwardly on the upper linkage member relative to the back-supporting portion, a compression coil spring engaged between the seat back and the upper linkage member of the resilient articulating linkage and yieldably biasing the seat back to an upward position relative to the back-supporting portion of the frame, a lumbar back separate from the seat bottom and the seat back mounted between the seat bottom and the seat back on the lumbar back-supporting portion of the frame for sliding movement, and bellows members connected between the lumbar back and the seat bottom and bellows members connected between the lumbar back and the seat back, the bellows members coupling the seat bottom, the lumbar back and the seat back for substantially conjoint movement so that when the seat bottom moves forwardly on the seat supporting portion of the frame, the lumbar back moves downwardly and upwardly along the lumbar supporting portion of the frame, and the seat back moves downwardly and upwardly along the upper linkage member of the articulating linkage in following relation to the sliding movements of the seat bottom.

2. Adjustable seating according to claim 1 wherein the frame includes spaced-apart members of generally L-shape in lateral profile and lying in parallel planes and the seat bottom and lumbar back have hollow socket portions receiving the seat-supporting and lumbar back-supporting portions of the frame members in telescoping relation.

3. Adjustable seating according to claim 2 wherein there is an articulating linkage attached to an upper end of each of the frame members, the upper linkage members have axes lying in parallel planes, and the upper back has a socket portion received in telescoping sliding relation on each upper linkage member.

4. Adjustable seating according to claim 2 wherein the lumbar back-supporting portion of each frame member is arcuate in lateral profile and the socket portions of the lumbar back are arcuate in lateral profile with curvatures matching the curvatures of the lumbar back-supporting portions.

5. Adjustable seating according to claim 1 wherein the lumbar back is retained in a floating condition relative to the seat back and seat bottom by the bellows members.

6. Adjustable seating according to claim 1 and further comprising coupling members connected between the lumbar back and the seat bottom and coupling members connected between the lumbar back and the seat back.

7. Adjustable seating according to claim 1 wherein the bellows members are elastomeric and the lumbar back is retained in a floating condition relative to the seat back and seat bottom by the resiliency of the bellows members.

8. Adjustable seating comprising a frame having spaced-apart tubular members of generally L-shape in lateral profile and lying in parallel planes, each frame member having a seat-supporting portion, a back-supporting portion and a lumbar back-supporting portion between the seat-supporting portion and the back-supporting portion;

a seat bottom having a pair of spaced-apart socket portions, each of which is received on one of the seat-supporting portions of the frame for sliding movement of the seat bottom between rearward and forward positions, a resilient articulating linkage affixed to the back-supporting portion of each of the frame members, each linkage having an upper linkage member and the upper linkage members lying in parallel planes, a seat back mounted on the back-supporting portion of the frame by the resilient articulating linkages for tilting movement between a resiliently restrained upright position and a tilted-back position and for sliding movement downwardly or upwardly relative to the back-supporting portion of the frame;

compression coil springs engaged between the seat back and the upper linkage members and yieldably biasing the seat back to an upward position;

a lumbar back separate from the seat bottom and the seat back mounted on the lumbar back-supporting portion of the frame for sliding movement, the lumbar back having a shell portion and a pair of spaced-apart socket portions, each of the socket portions being received in telescoping relation on the lumbar back-supporting portion of each frame member; and bellows members connected between the lumbar back and the seat bottom and bellows members connected between the lumbar back and the seat back, the bellows members coupling the seat bottom, the lumbar back and the seat back for movement substantially conjointly with each other.

* * * * *